US009805590B2

(12) United States Patent
Shennib

(10) Patent No.: US 9,805,590 B2
(45) Date of Patent: Oct. 31, 2017

(54) HEARING DEVICE AND METHODS FOR WIRELESS REMOTE CONTROL OF AN APPLIANCE

(71) Applicant: iHear Medical, Inc., San Leandro, CA (US)

(72) Inventor: Adnan Shennib, Oakland, CA (US)

(73) Assignee: iHear Medical, Inc., San Leandro, CA (US)

( * ) Notice: Subject to any disclaimer, the term of this patent is extended or adjusted under 35 U.S.C. 154(b) by 19 days.

(21) Appl. No.: 14/826,721

(22) Filed: Aug. 14, 2015

(65) Prior Publication Data

US 2016/0049074 A1 Feb. 18, 2016

Related U.S. Application Data

(60) Provisional application No. 62/037,616, filed on Aug. 15, 2014.

(51) Int. Cl.
*H04R 25/00* (2006.01)
*G08C 17/02* (2006.01)

(52) U.S. Cl.
CPC ..... *G08C 17/02* (2013.01); *H04R 25/558* (2013.01); *H04R 2225/023* (2013.01); *H04R 2225/55* (2013.01); *H04R 2225/61* (2013.01)

(58) Field of Classification Search
CPC ..... G08C 17/02; H04R 25/558; H04R 2225/558; H04R 2225/023; H04R 2225/55; H04R 2225/61; H04R 2225/025
See application file for complete search history.

(56) References Cited

U.S. PATENT DOCUMENTS 3,659,056 A 4/1972 Morrison et al.
4,628,907 A 12/1986 Epley
(Continued)

FOREIGN PATENT DOCUMENTS

KR 100955033 B1 4/2010
KR 1020100042370 A 4/2010
(Continued)

OTHER PUBLICATIONS

International Search Report and Written Opinion received for PCT Appl. PCT/US2015/045261 dated Nov. 27, 2015.
(Continued)

*Primary Examiner* — Andrew L Sniezek
(74) *Attorney, Agent, or Firm* — Dorsey & Whitney LLP

(57) ABSTRACT

The present disclosure describes examples of systems and methods of wireless remote control of appliances using a canal hearing device upon manual activation of a switch placed in the concha cavity behind the tragus. In some examples, the lateral end comprises one or more manually activated switches, a wireless antenna, and a battery cell. In some examples, the wireless electronics include low energy Bluetooth capability. The appliance may be any device with wireless control capability, for example an electronic lock, a thermostat, an electronic lighting, a telephone, a kitchen appliance, a medical alert system, a television, a medical device, and a smart glass. The inconspicuous and secure wear of the canal hearing device may allow a hearing device user to enjoy a normal lifestyle, including exercise, and to discretely interact with wirelessly controlled devices.

28 Claims, 13 Drawing Sheets

(56) References Cited

U.S. PATENT DOCUMENTS 4,759,070 A 7/1988 Voroba
4,817,607 A 4/1989 Tatge
5,003,608 A 3/1991 Carlson
5,197,332 A 3/1993 Shennib
5,327,500 A 7/1994 Campbell
5,425,104 A 6/1995 Shennib
5,553,152 A 9/1996 Newton
5,603,726 A 2/1997 Schulman et al.
5,615,229 A 3/1997 Sharma et al.
5,645,074 A 7/1997 Shennib et al.
5,659,621 A 8/1997 Newton
5,701,348 A 12/1997 Shennib et al.
5,785,661 A 7/1998 Shennib et al.
6,137,889 A 10/2000 Shennib et al.
6,212,283 B1 4/2001 Fletcher et al.
6,319,207 B1 11/2001 Naidoo
6,359,993 B2 3/2002 Brimhall
6,367,578 B1 4/2002 Shoemaker
6,379,314 B1 4/2002 Horn
6,382,346 B2 5/2002 Brimhall et al.
6,428,485 B1 8/2002 Rho
6,447,461 B1 9/2002 Eldon
6,473,513 B1 10/2002 Shennib et al.
6,522,988 B1 2/2003 Hou
6,546,108 B1 4/2003 Shennib et al.
6,674,862 B1 1/2004 Magilen
6,694,034 B2 2/2004 Julstrom et al.
6,724,902 B1 4/2004 Shennib et al.
6,840,908 B2 1/2005 Edwards et al.
6,937,735 B2 8/2005 DeRoo et al.
6,940,988 B1 9/2005 Shennib et al.
6,940,989 B1 9/2005 Shennib et al.
6,978,155 B2 12/2005 Berg
7,010,137 B1 3/2006 Leedom et al.
7,016,511 B1 3/2006 Shennib
7,037,274 B2 5/2006 Thornton et al.
7,113,611 B2 9/2006 Leedom et al.
7,164,775 B2 1/2007 Meyer et al.
7,181,032 B2 2/2007 Jakob et al.
7,215,789 B2 5/2007 Shennib et al.
7,221,769 B1 * 5/2007 Jorgensen ..... H04R 25/65 381/328
7,227,968 B2 6/2007 van Halteren et al.
7,260,232 B2 8/2007 Shennib
7,266,208 B2 9/2007 Charvin et al.
7,298,857 B2 11/2007 Shennib et al.
7,310,426 B2 12/2007 Shennib et al.
7,321,663 B2 1/2008 Olsen
7,330,101 B2 2/2008 Sekura
7,403,629 B1 7/2008 Aceti et al.
7,421,087 B2 9/2008 Perkins et al.
7,424,123 B2 9/2008 Shennib et al.
7,424,124 B2 9/2008 Shennib et al.
7,512,383 B2 3/2009 Essabar et al.
7,580,537 B2 8/2009 Urso et al.
7,664,282 B2 2/2010 Urso et al.
7,720,242 B2 5/2010 Anderson et al.
7,751,578 B2 7/2010 Arz et al.
7,854,704 B2 12/2010 Givens et al.
7,945,065 B2 5/2011 Menzl et al.
8,036,405 B2 10/2011 Ludvigsen et al.
8,073,170 B2 12/2011 Kondo et al.
8,077,890 B2 12/2011 Schumaier
8,116,494 B2 2/2012 Rass et al.
8,155,361 B2 4/2012 Schindler
8,175,306 B2 5/2012 Meskens et al.
8,184,842 B2 5/2012 Howard et al.
8,243,972 B2 8/2012 Latzel
8,284,968 B2 10/2012 Schumaier
8,287,462 B2 10/2012 Givens et al.
8,340,335 B1 12/2012 Shennib
8,379,871 B2 2/2013 Michael et al.
8,396,237 B2 3/2013 Schumaier
8,447,042 B2 5/2013 Gurin
8,467,556 B2 6/2013 Shennib et al.
8,571,247 B1 10/2013 Oezer
8,718,306 B2 5/2014 Gommel et al.
8,767,986 B1 7/2014 Fabry et al.
8,798,301 B2 8/2014 Shennib
8,855,345 B2 10/2014 Shennib et al.
8,867,768 B2 10/2014 Contioso et al.
9,002,046 B2 4/2015 Jones et al.
9,060,233 B2 6/2015 Shennib et al.
2001/0008560 A1 7/2001 Stonikas et al.
2002/0027996 A1 3/2002 Leedom et al.
2002/0085728 A1 7/2002 Shennib et al.
2003/0007647 A1 1/2003 Nielsen et al.
2004/0138723 A1 7/2004 Malick et al.
2004/0165742 A1 8/2004 Shennib et al.
2004/0234092 A1 11/2004 Wada et al.
2005/0190938 A1 9/2005 Shennib et al.
2005/0245991 A1 11/2005 Faltys et al.
2005/0249370 A1 11/2005 Shennib et al.
2005/0259840 A1 11/2005 Gable et al.
2005/0283263 A1 12/2005 Eaton et al.
2006/0210104 A1 9/2006 Shennib et al.
2006/0291683 A1 12/2006 Urso et al.
2007/0076909 A1 4/2007 Roeck et al.
2007/0127757 A2 6/2007 Darbut et al.
2007/0255435 A1 11/2007 Cohen et al.
2007/0274553 A1 11/2007 Rass et al.
2008/0095387 A1 4/2008 Niederdrank et al.
2008/0240452 A1 10/2008 Burrows et al.
2008/0273726 A1 11/2008 Yoo et al.
2009/0052706 A1 2/2009 Gottschalk et al.
2009/0169039 A1 7/2009 Rasmussen et al.
2009/0196444 A1 8/2009 Solum et al.
2010/0027824 A1 2/2010 Atamaniuk et al.
2010/0040250 A1 2/2010 Gebert
2010/0086157 A1 4/2010 Feeley et al.
2010/0119094 A1 5/2010 Sjursen et al.
2010/0145411 A1 6/2010 Spitzer
2010/0201513 A1 8/2010 Vorenkamp et al.
2010/0232612 A1 * 9/2010 Basseas ..... H04R 25/305 381/60
2010/0239112 A1 9/2010 Howard et al.
2010/0254553 A1 10/2010 Nikles et al.
2010/0254554 A1 10/2010 Fusakawa et al.
2010/0272299 A1 10/2010 Van Schuylenbergh et al.
2010/0284556 A1 11/2010 Young
2011/0019847 A1 1/2011 Klemenz et al.
2011/0058697 A1 3/2011 Shennib et al.
2011/0091060 A1 4/2011 von Dombrowski et al.
2011/0182453 A1 7/2011 Van Hal et al.
2011/0188689 A1 8/2011 Beck et al.
2011/0200216 A1 8/2011 Lee et al.
2011/0206225 A1 8/2011 Møller et al.
2011/0221391 A1 9/2011 Won et al.
2011/0243357 A1 10/2011 Probst et al.
2011/0286616 A1 11/2011 Beck et al.
2011/0293123 A1 12/2011 Neumeyer et al.
2012/0051569 A1 3/2012 Blamey et al.
2012/0130271 A1 5/2012 Margolis et al.
2012/0183164 A1 7/2012 Foo et al.
2012/0183165 A1 7/2012 Foo et al.
2012/0189140 A1 7/2012 Hughes
2012/0189146 A1 7/2012 Wuidart
2012/0213393 A1 8/2012 Foo et al.
2012/0215532 A1 8/2012 Foo et al.
2012/0302859 A1 11/2012 Keefe
2013/0010406 A1 1/2013 Stanley
2013/0243209 A1 9/2013 Zurbruegg et al.
2013/0243229 A1 9/2013 Shennib et al.
2013/0294631 A1 11/2013 Shennib et al.
2014/0003639 A1 1/2014 Shennib et al.
2014/0150234 A1 6/2014 Shennib et al.
2014/0153761 A1 6/2014 Shennib et al.
2014/0153762 A1 6/2014 Shennib et al.
2014/0254843 A1 9/2014 Shennib
2014/0254844 A1 9/2014 Shennib
2015/0023512 A1 1/2015 Shennib
2015/0023534 A1 1/2015 Shennib
2015/0139474 A1 5/2015 Henry et al.
2015/0382198 A1 12/2015 Kashef et al.

(56) References Cited

U.S. PATENT DOCUMENTS

| | | | |
|---|---|---|---|
| 2016/0057550 | A1 | 2/2016 | Shennib |
| 2016/0100261 | A1 | 4/2016 | Shennib |
| 2016/0134742 | A1 | 5/2016 | Shennib |

FOREIGN PATENT DOCUMENTS

| | | | |
|---|---|---|---|
| WO | 99/07182 | A2 | 2/1999 |
| WO | 2010/091480 | A1 | 8/2010 |
| WO | 2011128462 | A2 | 10/2011 |
| WO | 2015009564 | A1 | 1/2015 |
| WO | 2015009569 | A1 | 1/2015 |
| WO | 2016025826 | A1 | 2/2016 |

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.
"Methods for Calculation of the Speech Intelligibility Index", American National Standards Institute, Jun. 6, 1997.
"Specification for Audiometers", American National Standards Institute, Nov. 2, 2010.
"User Manual—2011", AMP Personal Audio Amplifiers.
Abrams, , "A Patient-adjusted Fine-tuning Approach for Optimizing the Hearing Aid Response", The Hearing Review, Mar. 24, 2011, 1-8.
Asha, "Type, Degree, and Configuration of Hearing Loss", American Speech-Language-Hearing Association; Audiology Information Series, May 1-2, 2011.
Convery, et al., "A Self-Fitting Hearing Aid: Need and Concept", http://tia.sagepubl.com, Dec. 4, 2011, 1-10.
Franks, "Hearing Measurements", National Institute for Occupational Safety and Health, Jun. 2006, 183-232.
Kiessling, "Hearing aid fitting procedures—state-of-the-art and current issues", Scandinavian Audiology vol. 30, Suppl 52, 2001, 57-59.
Nhanes, "Audiometry Procedures Manual", National Health and Nutrition Examination Survey, Jan. 2003, 1-105.
Traynor, "Prescriptive Procedures", www.rehab.research.va.gov/mono/ear/traynor.htm, Jan. 1999, 1-16.
World Health Organization, "Deafness and Hearing Loss", www.who.int/mediacentre/factsheets/fs300/en/index.html, Feb. 2013, 1-5.
Wu, et al., "Selective Signal Transmission to Inlaid Microcoils by Inductive Coupling", IEEE Transducers 2003, 12th International Conference of Solid State Sensors Transducers, Boston 2003.

* cited by examiner

HEARING DEVICE AND METHODS FOR WIRELESS REMOTE CONTROL OF AN APPLIANCE

CROSS-REFERENCE TO RELATED APPLICATIONS

This application claims the benefit under 35 U.S.C. 119 of the earlier filing date of U.S. Provisional Application No. 62/037,616 entitled "CANAL HEARING DEVICE AND METHODS FOR WIRELESS REMOTE CONTROL OF AN APPLIANCE," filed Aug. 15, 2014. The aforementioned provisional application is hereby incorporated by reference in its entirety, for any purpose.

TECHNICAL FIELD

Examples described herein relate to hearing devices, and include particularly canal hearing devices including wireless capabilities for actuation or control of an appliance in proximity.

BACKGROUND

The ear canal 10, as illustrated in FIG. 1, is generally narrow and tortuous, and is approximately 26 millimeters (mm) long from the canal aperture 11 to the tympanic membrane 15 (eardrum). The lateral part of the ear canal 10 is referred to as the cartilaginous region 12 due to the underlying cartilaginous tissue 16 beneath the skin. The medial part, proximal to the tympanic membrane 15, is relatively rigid and referred to as the bony region 13 due to the underlying bone tissue 17. A characteristic first bend occurs roughly at the aperture 11 (FIG. 1) of the ear canal 10. The concha cavity 5 is just outside the ear canal 10 behind the tragus 3. A second characteristic bend occurs roughly at the bony-cartilaginous junction 8 and separates the cartilaginous region 12 and the bony region 13. The two bends inside the ear canal 10 define a characteristic "S" shape. Just outside the ear canal 10 is the concha cavity 5, which is hidden behind a backward projecting eminence known as the tragus 3. The ear canal 10 and concha cavity 5 are generally hidden from view from the front and side by the presence of the tragus 3, and also hidden from the back by the presence of the pinna (also referred to as auricle). Therefore, placement of a hearing device inside the concha cavity 5 and into the ear canal 10 is highly advantageous for highly inconspicuous wear. The dimensions and contours of the ear canal 10 vary significantly among individuals.

Placement of a canal hearing device inside the ear can be challenging due to difficulty in access and manipulation of a miniature canal device, particularly when placed deeply inside the ear canal 10. However, it is generally desirable to place a hearing device inside the ear canal 10 for achieving various advantages including reduction of the acoustic occlusion effect, improved energy efficiency, reduced distortion, reduced receiver (speaker) vibrations, and improved high frequency response. A well-known advantage of ear canal 10 placement is aesthetics as many hearing-impaired individuals refuse to wear visible hearing devices such as in-the-ear (ITE) or behind-the-ear (BTE) types.

Placement of a hearing device inside the ear canal 10 is generally desirable for various electroacoustic advantages such as reduction of the acoustic occlusion effect, improved energy efficiency, reduced distortion, reduced receiver vibrations, and improved high frequency response. A canal hearing device can be inserted entirely or partially inside the ear canal. In the context of this application, any hearing device inserted inside the ear canal, whether partially or completely, may be referred to as a canal hearing device. This includes what is known in the hearing aid industry as Completely-In-The-Canal (CIC) and In-The-Canal (ITC) types.

Switches placed on canal hearing devices are generally difficult to reach or activate. These switches may be cumbersome if not impossible for those with dexterity limitations. Switches for hearing devices are generally implemented for larger hearing devices such as BTEs and ITEs for access and manual manipulation to deal with dexterity limitations.

Current hearing devices include wireless capabilities to receive transmit a variety of signals. The signals may include telephony audio, consumer electronics audio, and/or programming signals. In some examples, hearing devices connect to a computing device such as a mobile device or a personal computer to receive the wireless signals. In some examples, wireless hearing devices connect with an intermediary device that receives wireless signals from a source device external to the hearing device and re-transmits or relays the signal to the hearing device in proximity to the intermediary device.

SUMMARY

A hearing system may include a canal hearing device and a computing device. The canal hearing device may include a medial portion, a lateral portion, and wireless electronics. In some examples, the canal hearing device may be modular. The medial portion may include a speaker. The medial portion may be configured for placement inside an ear canal of an ear. In some examples, the medial portion may include a sound processor configured to generate an audible signal. The speaker may be configured to provide the audible signal inside the ear canal.

The lateral portion may include a wireless antenna and a switch. In some examples, the lateral portion may include a battery cell. The switch may be arranged on the lateral portion such that the switch is located in a concha cavity of the ear when the medial portion is placed inside the ear canal. The switch may be positioned behind a tragus of the ear. The switch may be configured for manual activation. In some examples, the lateral portion may include a handle portion and the switch may be on the handle portion.

The wireless electronics may be communicatively coupled to the wireless antenna. The wireless electronics may be configured to transmit a wireless signal to the external appliance via the wireless antenna when the external appliance is within proximity to the canal hearing device and responsive to manual activation of the switch. In some examples, the wireless signal may be configured to control any of an electronic lock, an electronic lighting, a telephone, a medical alert system, a television, a medical device, and electronic glass. The canal hearing device may produce an audible sound from the speaker when the canal hearing device is worn in the ear and in proximity to the external appliance. The audible sound may be produced in response to receiving a wireless signal from the external appliance. The canal hearing device may terminate production of the audible sound in response to a manual activation of the switch.

The computing device may be separate from the canal hearing device. The computing device may be communicatively coupled to the canal hearing device. The canal hearing device may receive configuration parameters from the computing device. The canal hearing device may include memory for storing the configuration parameters. The canal hearing device may control the external appliance in accordance with the configuration parameters.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION

Certain details are set forth below to provide a sufficient understanding of embodiments of the invention. However, it will be appreciated by one skilled in the art that some embodiments may not include all details described. In some instances, well-known structures, hearing aid components, circuits, and controls, have not been shown in order to avoid unnecessarily obscuring the described embodiments of the invention.

The present disclosure describes examples of systems and methods of wireless remote control of appliances using a canal hearing device in proximity thereto. One embodiment of the present disclosure involves a canal hearing device including a switch for manual activation. In some examples, the canal hearing device may control an appliance external to the ear upon manual activation of the switch.

Figure 1:
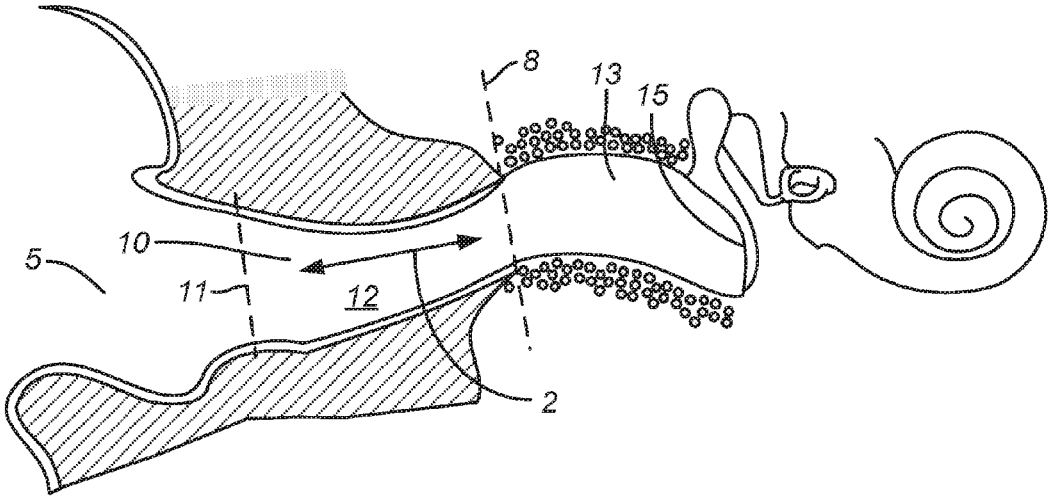
FIG. 1 (Prior Art)
FIG. 1 is a view of the ear canal showing the bony and cartilaginous regions, and the concha cavity.
Figure 2:
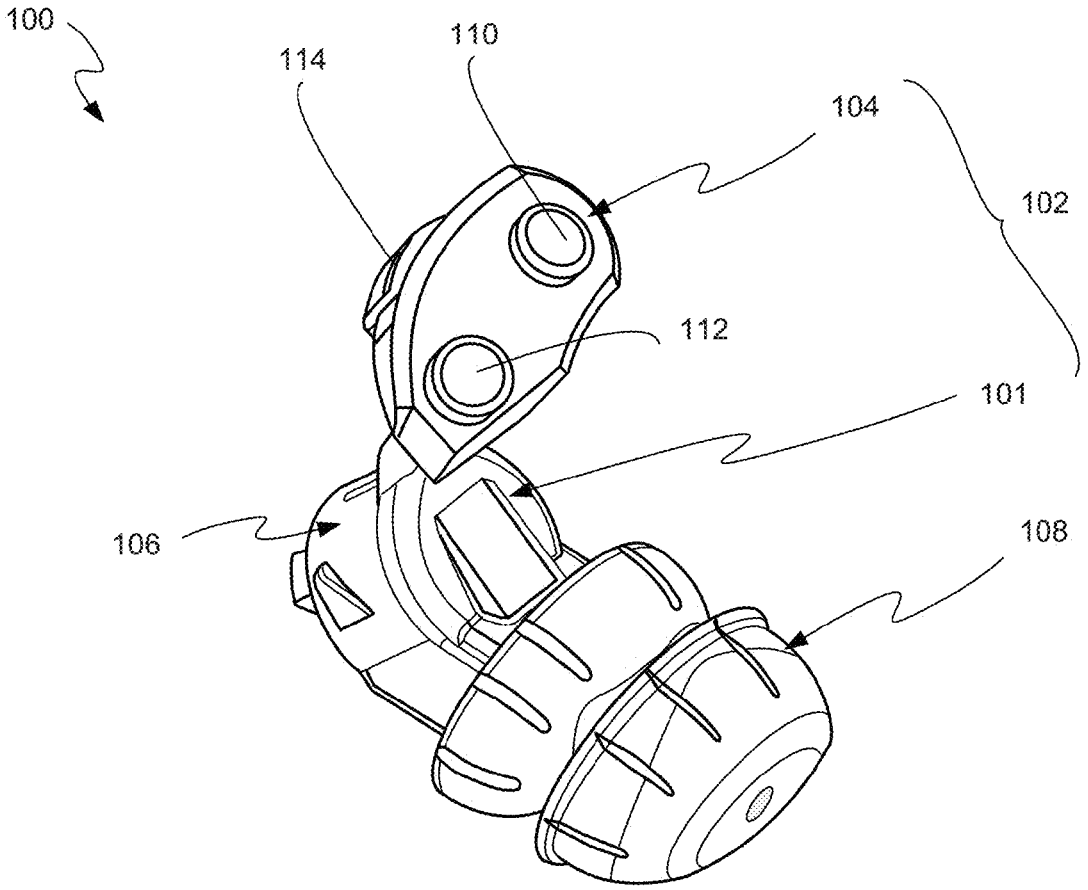
FIG. 2 is a view of a canal hearing device including button switches for wireless remote control of an appliance, according to some examples.
Figure 3:
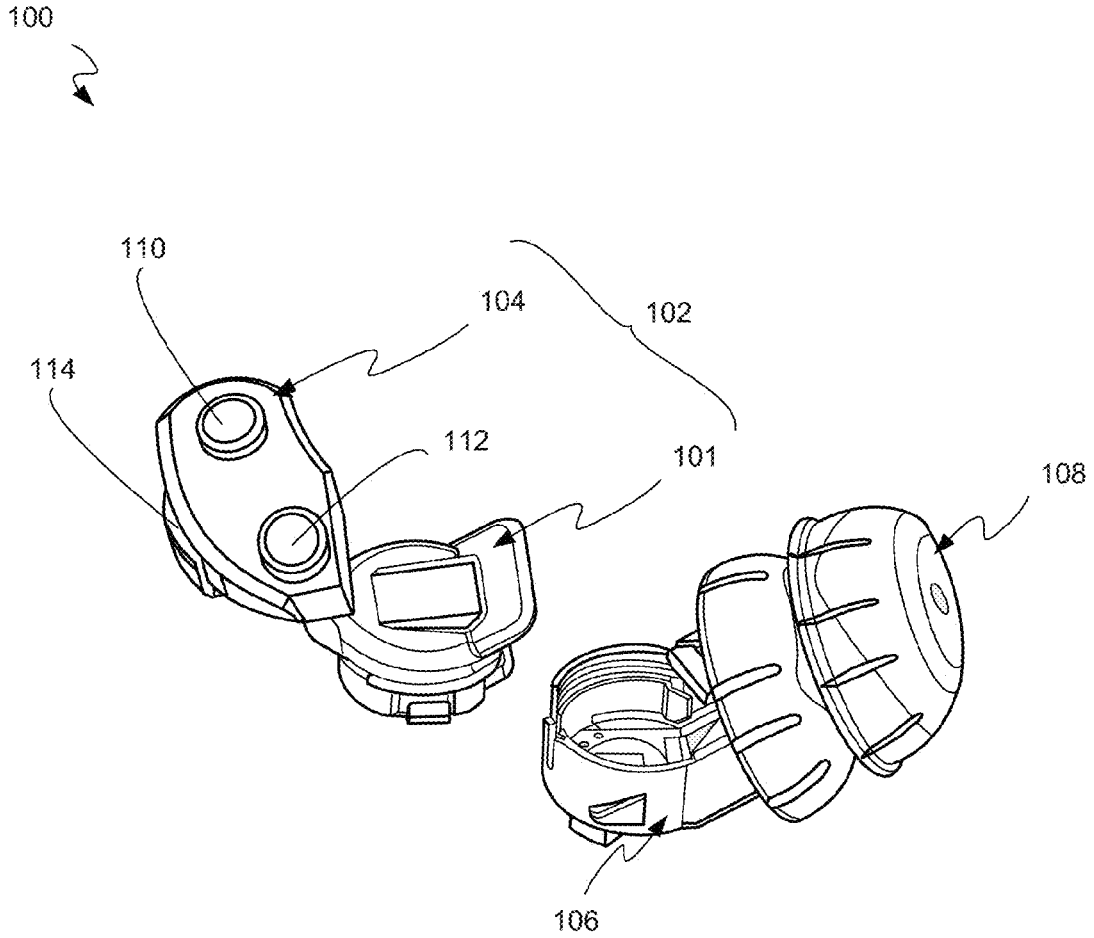
FIG. 3 is a view of a canal hearing device according to some examples herein, with the lateral end of the canal hearing device detached from the medial end of the canal hearing device.
Figure 9:
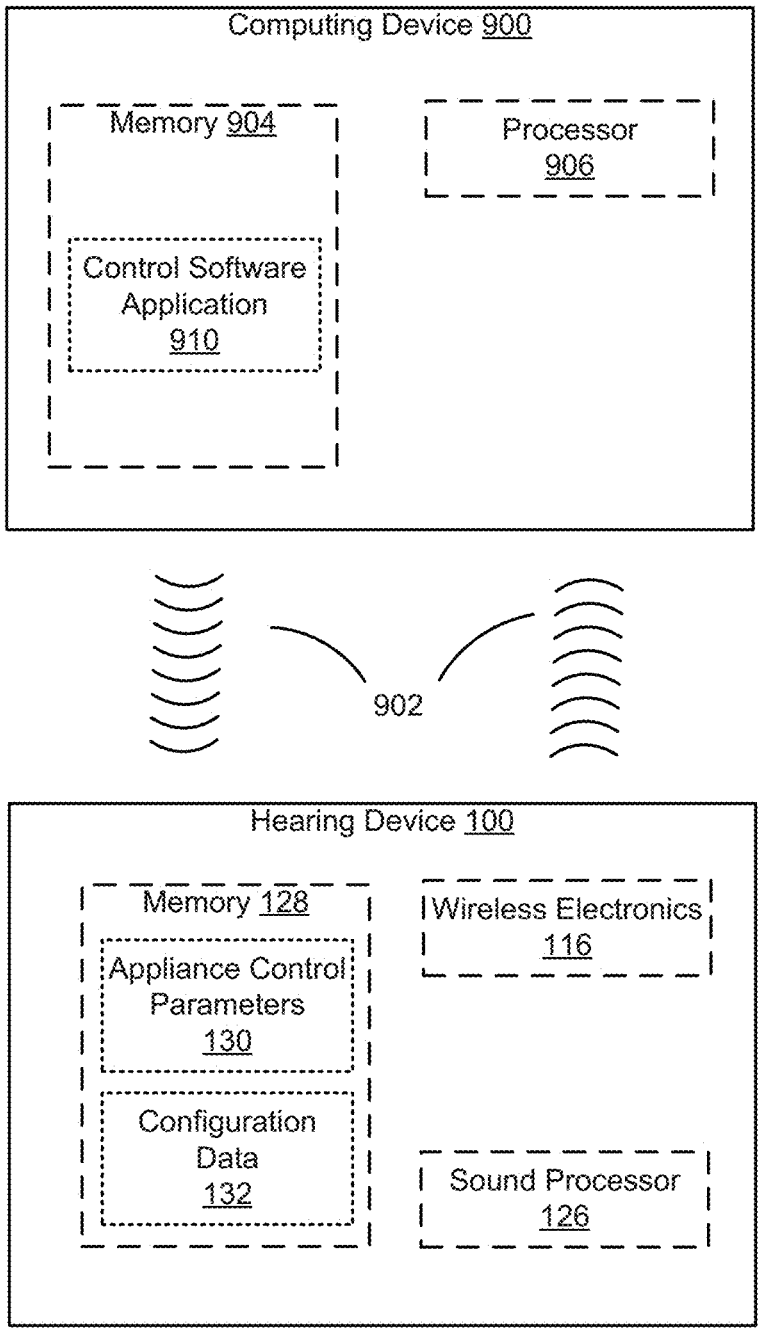
FIG. 9 is a block diagram of an operational environment including a canal hearing device communicatively coupled to a computing device for configuring appliance control parameters, according to some examples.
Figure 10:
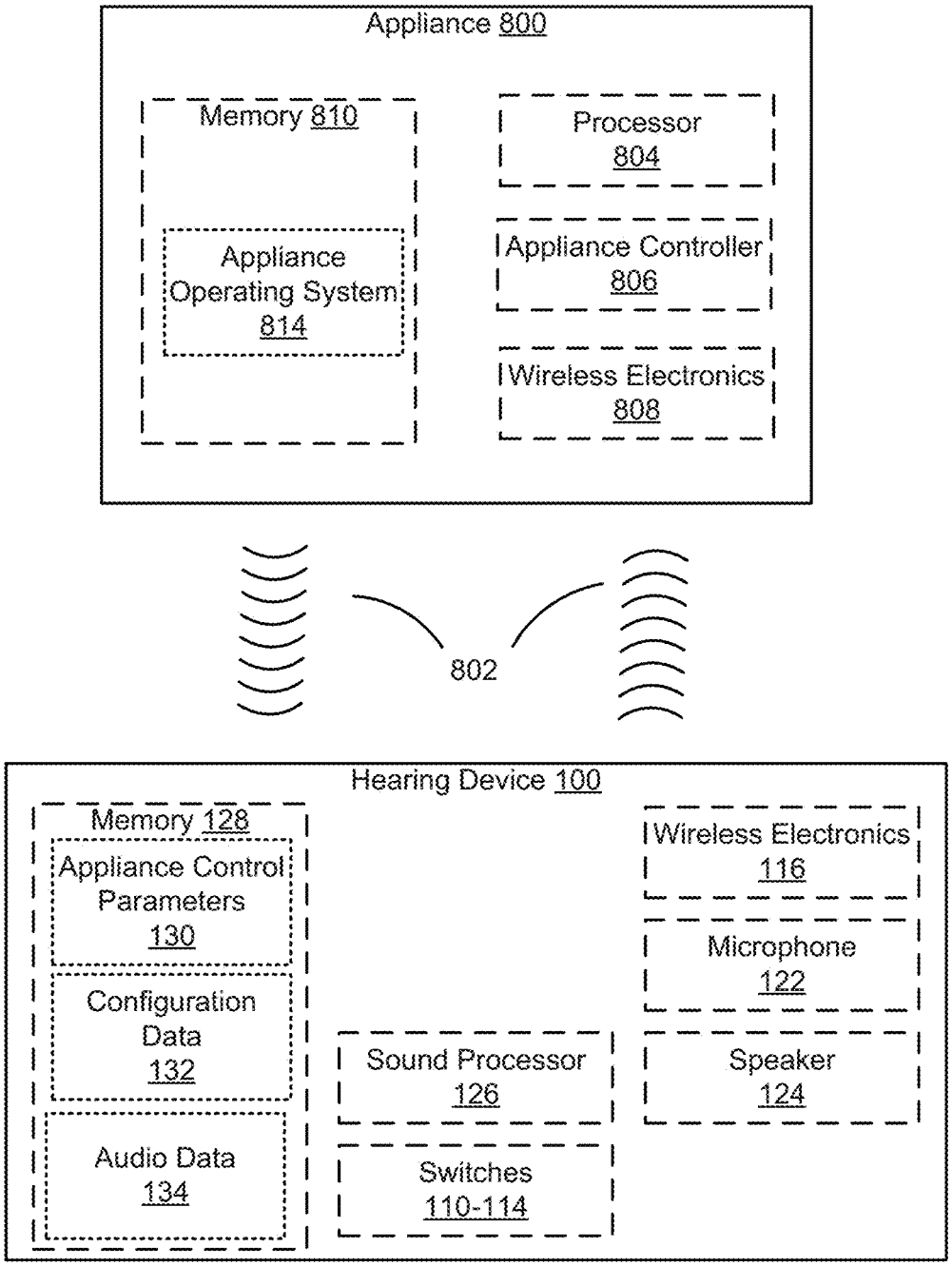
FIG. 10 is a block diagram of an operational environment including a canal hearing device communicatively coupled to an appliance for wireless remote control of the appliance, according to some examples.

FIGS. 2 and 3 show examples of a canal hearing device 100, according to the present disclosure. The canal hearing device 100 may include a medial end 106 (also referred to herein as "medial portion"), a lateral end 102 (also referred to herein as "lateral portion"), a compliant sealing retainer 108. The canal hearing device may include wireless electronics 116 (e.g., as illustrated in FIG. 9). The lateral end 102 may be coupled electrically and mechanically to the medial end 106 for operation of the canal hearing device 100 in the ear. In some examples, the medial end 106 may be integrated with the lateral end 102. In some examples, the canal hearing device may be a modular canal hearing device 100 which includes a medial end 106 (also referred to herein as "main module") and a lateral end 102 (also referred to herein as "lateral module") removably coupled to the lateral end 102. The lateral end 102 may be detachable from the medial end 106, for example for replacement of a battery cell which may be received, at least partially, within the lateral end 102. In some examples, the lateral end 102 may include a detachable and/or disposable battery module. The medial end 106 may be configured to at least partially disengage from the lateral end 102, e.g., as illustrated in FIG. 3 where the medial end 106 is shown detached from the lateral end 102. Partial disengagement may provide the canal hearing device 100 in an OFF condition. Full disengagement may be advantageous for example canal hearing devices with a replaceable lateral end 102. Engagement between the medial end 106 and lateral end 102 may provide the canal hearing device 100 in an ON condition. The canal hearing device 100 may be sized and shaped for placement substantially inside the ear canal 10 and extending to the concha cavity 5 behind the tragus 3. The medial end 106 may be placed inside an ear canal 10. The canal hearing device 100 (FIG. 10) may include any of a speaker 124, a microphone 122, a sound processor 126, memory 128 and circuitry.

The lateral end 102 may be positioned lateral to (away from the eardrum 15) and may include a battery portion 101 and a handle portion 104 (also referred to herein as "handle") for placement in the concha cavity 5 behind the tragus 3. The lateral end 102 may include one or more switches, a wireless antenna, and a battery cell. The lateral end 102 may be removable, partially disengageable, or integral with the medial end 106. The lateral end 102 may further include a sound port and sound channel for receiving incoming sound, for example as described in U.S. Pat. No. 8,467,556, titled CANAL HEARING DEVICE WITH DISPOSABLE BATTERY MODULE ("'556 patent"), and U.S. Pat. No. 8,855,345, titled BATTERY MODULE FOR PERPENDICULAR DOCKING INTO A CANAL HEARING DEVICE ("'345 patent"), which are both incorporated herein by reference in their entirety for any purpose. In some examples, the compliant sealing retainer 108 may be removably coupled to the medial end 106 and configured to retain the medial end 106 in the ear canal 10. In some examples, the compliant sealing retainer 108 may be removable and provided in an assortment of sizes to fit in a variety of ear canal shapes and sizes.

Figure 6:
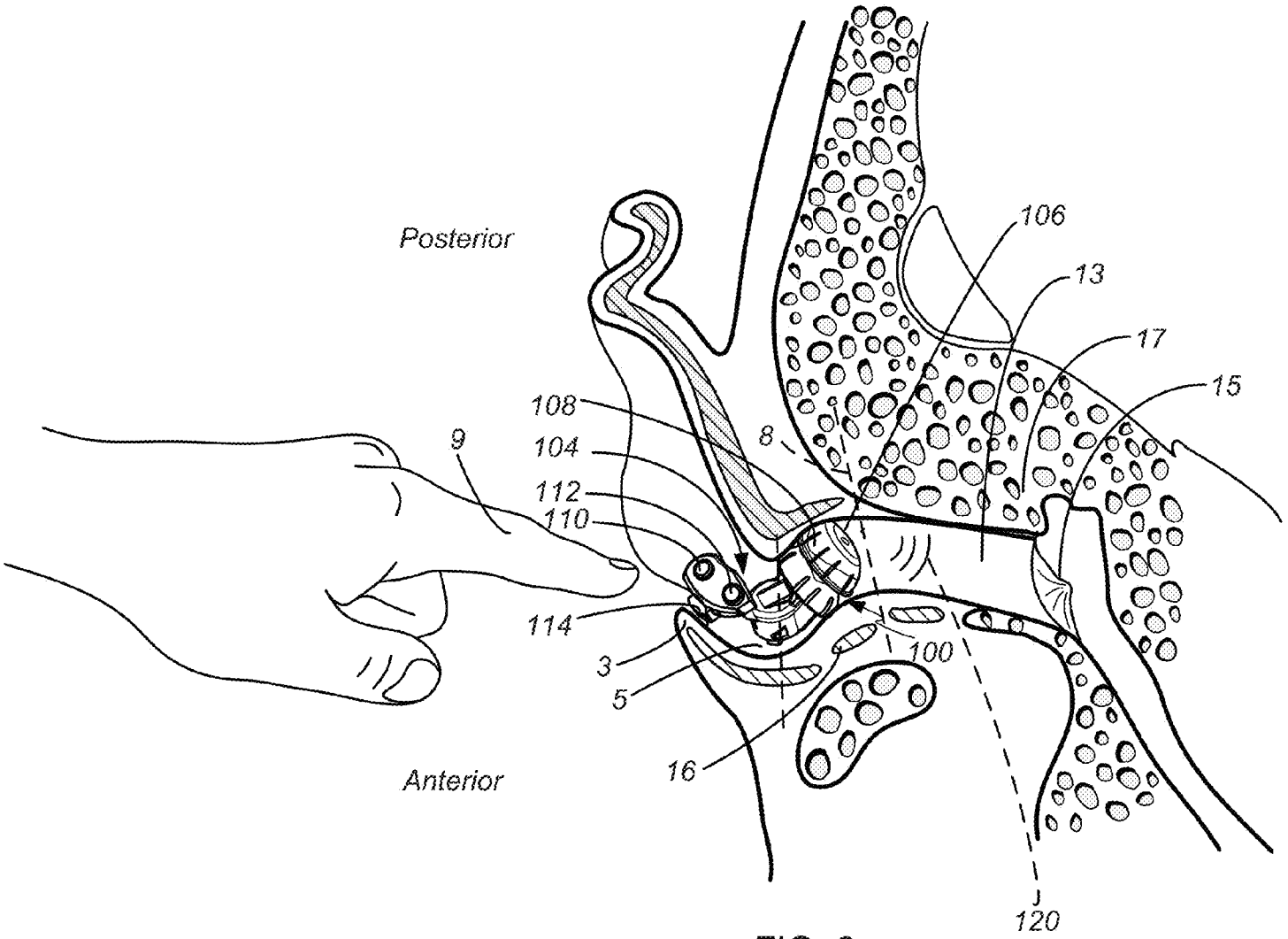
FIG. 6 is a transverse view of the ear canal showing a canal hearing device with switches provided on a handle positioned behind the tragus when viewed from the front or side, according to some examples.
Figure 7:
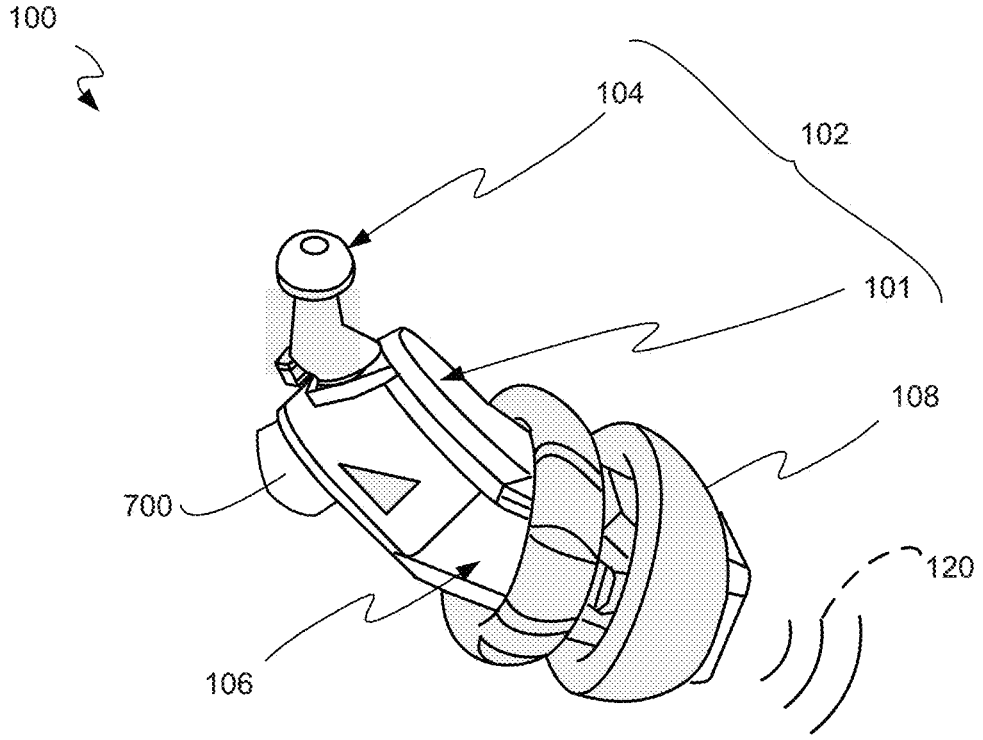
FIG. 7 is view of a canal hearing device including a button switch on a side of a lateral end for activation by a manual force applied to a tragus and wireless remote control of an appliance, according to some examples.

The lateral end 102 may include one or more switches that may be activated in response to a manual force. In some examples, the one or more switches may be provided on the handle 104 of the canal hearing device. In some examples, the one or more switches may be provided on a housing of the lateral end 102, such as on the side of the housing (FIG. 7). In some examples, a first switch 114 may be activated indirectly by a manual force applied to a tragus 3. In some examples, the first switch 114 may be arranged on the lateral end 102 such that the first switch 114 is oriented towards the tragus 3 when the medial portion 106 is placed inside the ear canal. In this manner, the application of manual force to the tragus 3 may cause the tragus 3 to contact the first switch 114 thereby activating the first switch 114. In some examples, a second switch 110 may be activated by a manual force directly applied to a first area of the handle 104. In some examples, a third switch 112 may be activated by a manual force directly applied to a second area of the handle 104. Any of the one or more switches may be arranged on the lateral end 102 of the canal hearing device such that one or more of the switches are located in the concha cavity 5. In this manner, one or more of the switches may be generally hidden behind the tragus 3 (FIG. 6) for conspicuous wear of the canal hearing device in the ear. The one or more switches may include a button switch (FIGS. 2-3 and 7-8), a rocker switch 502 (FIG. 4), a proximity sensor switch (not shown), a capacitive switch (not shown), and/or other known switches suitable for manual activation.

Figure 4:
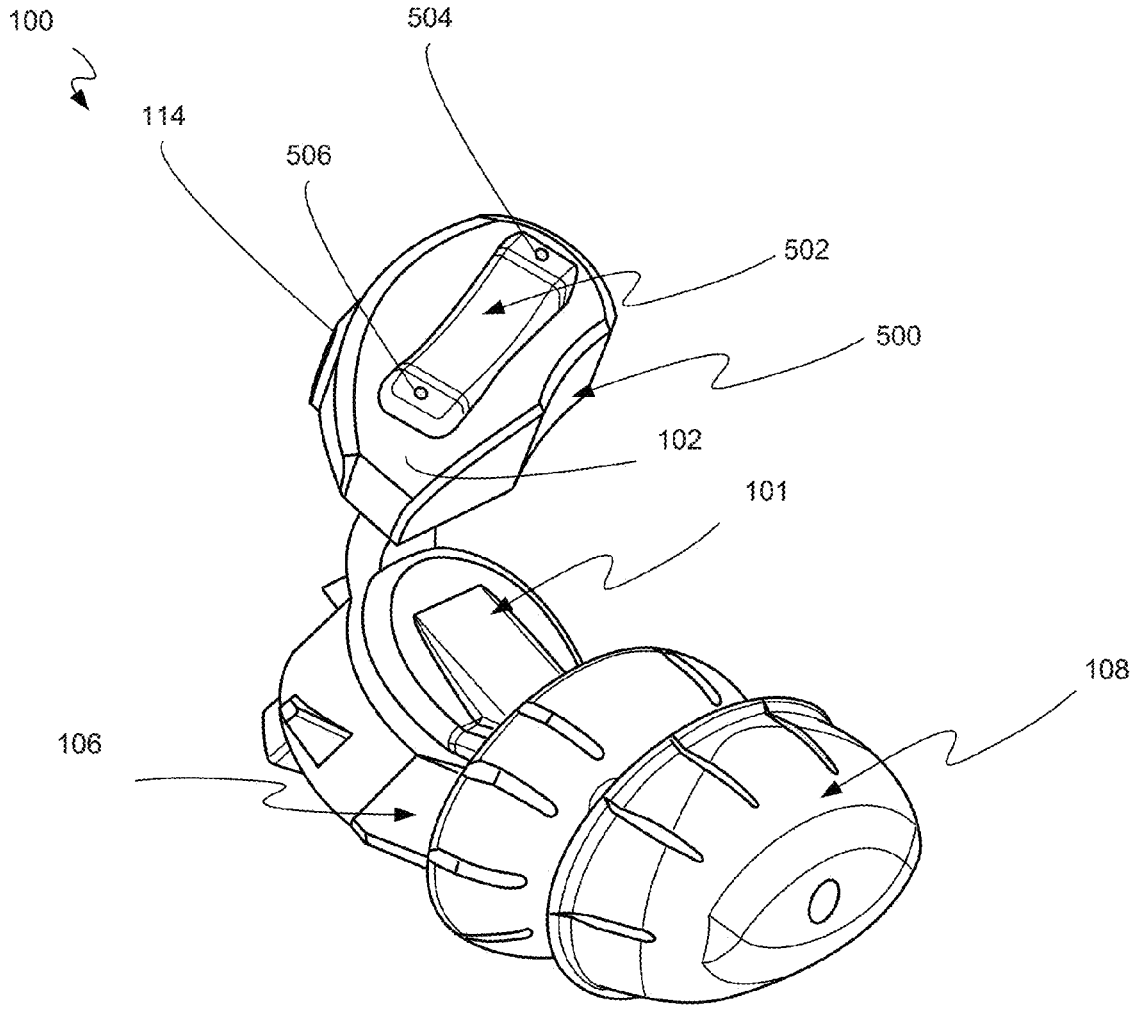
FIG. 4 is a view of a canal hearing device including a rocker switch for wireless remote control of an appliance, according to some examples.
Figure 8:
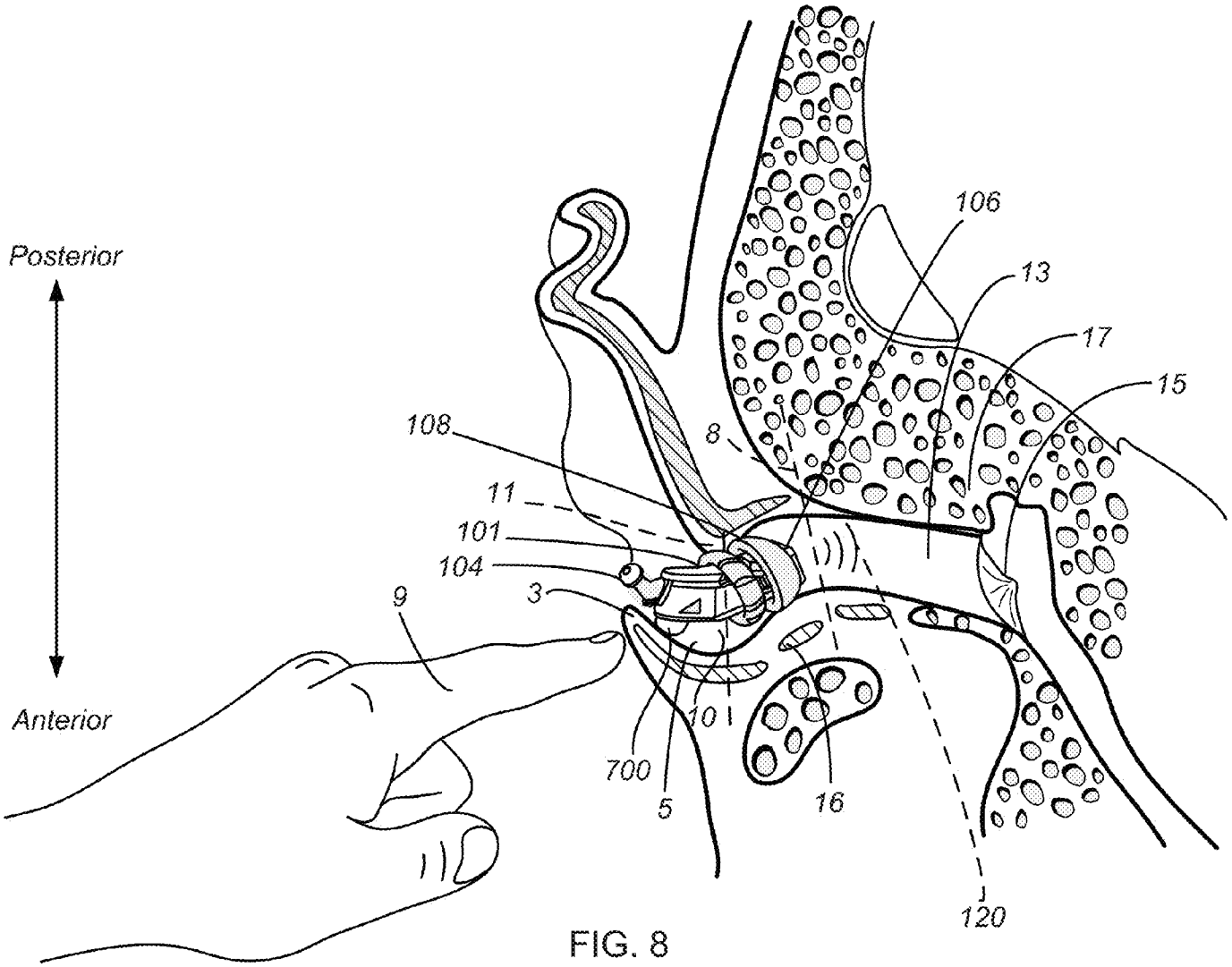
FIG. 8 is a transverse view of the canal hearing device of FIG. 7 showing the activation of the switch by a manual force applied to a tragus, according to some examples.
Figure 11:
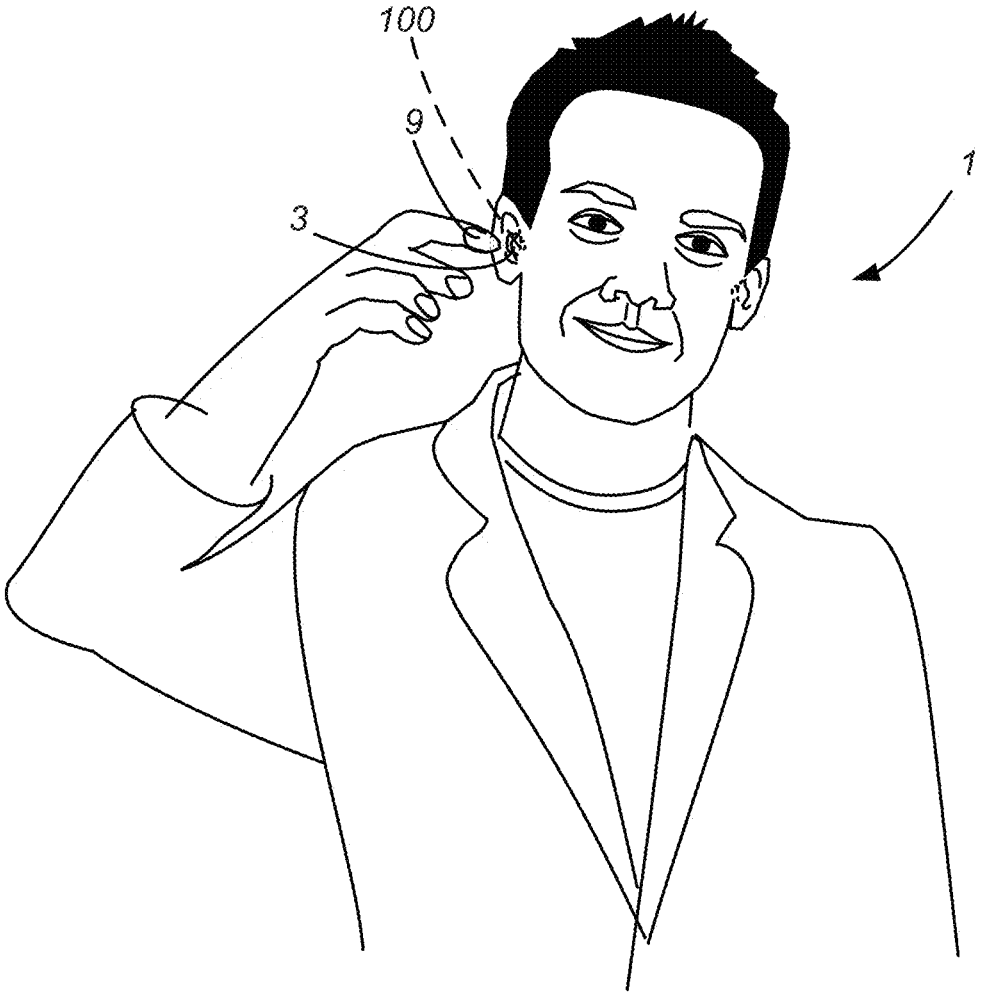
FIG. 11 is an illustration of a canal hearing device inserted in an ear canal of a user such that switches of the canal hearing device are positioned behind a tragus for manual activation by a finger of the user, according to some examples.

In some examples, the one or more switches may be implemented as a rocker switch 502 on a handle 500 of the canal hearing device 100, as shown in FIG. 4. The rocker switch 502 may include two switches each configured to be manually activated. The two switches may include a first switch 504 located at a first end of the rocker switch 502 and a second switch 506 located at a second end of the rocker switch 502. Manual manipulation of either of the first or second end of the rocker switch (e.g., a pressure applied to the first end or the second end) may cause activation of the respective switch located at that end. In some examples, any of the switches may be positioned such that they may be reached by a finger 9 of a user 1, as shown in FIGS. 6 and 11. Alternatively, a switch 700 may be provided on a side of the lateral end 102 such that the switch 700 is behind the tragus 3 when the medial end 106 of the canal hearing device 100 is positioned in the ear canal 10, as shown in FIG. 8. In some examples, the user 1 may apply a manual force to the tragus 3 using a finger 9 to activate the switch. In some examples, the user 1 may apply a manual force to the tragus 3 using a tool to activate the switch.

The lateral end 102 may include a wireless antenna. In some examples, the wireless antenna may be a chip antenna, for example a ceramic chip antenna. The wireless antenna may be communicatively coupled to wireless electronics 116 of the canal hearing device 100. The wireless electronics 116 may be provided in any of the medial end 106 or the lateral end 102. The wireless electronics 116 may include functionality to transmit and receive wireless signals. The wireless electronics 116 may utilize standardized protocols, such as Bluetooth, near-field magnetic induction, Wi-Fi, Zigbee or any other known wireless protocol. In some examples, the wireless electronics 116 include low power and low energy functionalities compatible with miniature button cell or coin cell batteries that are commonly used for hearing aids and miniature electronic devices. Bluetooth, including Low Energy (LE) versions, is particularly suited.

Figure 5:
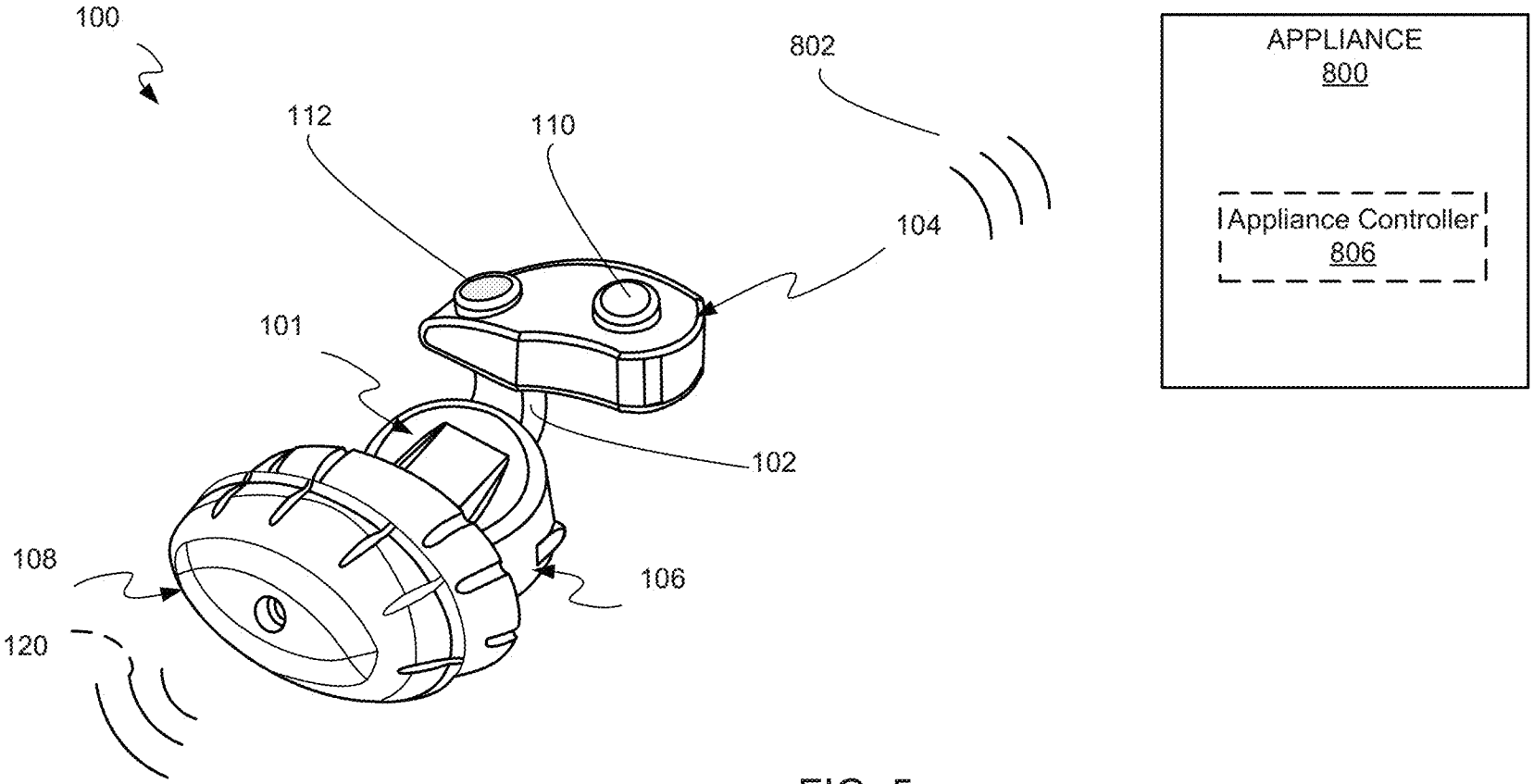
FIG. 5 is a view of a canal hearing device including a handle and switches provided on the handle for wireless control of an appliance, according to some examples.

The wireless electronics 116 may communicate wirelessly with an appliance 800 (FIG. 5) external to the ear. The appliance 800 external to the ear may interchangeably be referred to herein as external appliance 800. The appliance 800 may be any device with wireless capability, for example an electronic lock (e.g., electronic door lock), a thermostat, electronic lighting (e.g., electronic room lighting), a telephone, a kitchen appliance, a medical alert system, a television, a medical device including an electronic medicine dispensing bottle, or a smart glass (also referred to herein as "electronic glass"). The appliance 800 may include wireless electronics 808 for communicatively coupling with the canal hearing device 100 and receiving control signals therefrom. An appliance controller 806 of the appliance 800 may provide access to configuration data including control parameters such as ON/OFF, Open/Close, Up/Down (e.g., volume), and Increase/Decrease (e.g., temperature). Typically, these control parameters are controlled by switches on the appliance 800 itself, or by an external remote control. More recently, appliance operating systems 814 may include functionality for wireless control by a Smartphone and a control software application 910. In some examples, the switches of the canal hearing device 100 may include an electromechanical type, a capacitive touch type, or optical sensor. When the appliance 800 is out of reach of the user 1, an external remote control device or a Smartphone may be used to control the appliance 800. Examples disclosed herein may mitigate the need to rely on inaccessible devices and methods for the remote control of an appliance 800 by using the canal hearing device 100 to control the appliance 800 (e.g., to operate controls of the appliance and/or activate the appliance 800).

The wireless electronics 116 of the canal hearing device 100 may communicatively couple with wireless electronics 808 of the appliance 800 to transmit and receive wireless signals 802. The wireless signals 802 may include commands, audio, and/or any other type of data. In some examples, the wireless electronics 116 of the canal hearing device 100 may transmit a wireless signal 802 in response to the manual activation of any of the one or more switches of the canal hearing device 100. The wireless signal 802 may include a signal configured to control the appliance 800. The wireless signal 802 may be received by the appliance 800, and a processor 804 of the appliance 800 may be in communication with the appliance controller 806 and an appliance operating system 814 to control the appliance 800. The appliance 800 may include memory 810 for storing appliance configuration data and the appliance operating system 814. The appliance configuration data may include control parameters for control and/or actuation of the appliance 800 in response to receiving the wireless signal 802. Thus, the user 1 may apply a manual force to the tragus 3 and/or directly to any of the switches 110-114 of the canal hearing device 100 to control the appliance 800. The actuation and/or control of the appliance 800 may include adjustment of the appliance 800 as discussed above, such as manipulating a light or lock. This may be advantageous to use a canal hearing device 100 as a remote control to mitigate the need for an external remote device such as a mobile phone.

In some examples, the canal hearing device 100 may automatically detect the presence of an external appliance 800 in proximity. In other words, the canal hearing device 100 may be configured to automatically detect the external appliance 800 when the external appliance 800 is within a wireless detection range. The appliance 800 may be in sufficient proximity to the canal hearing device 100 such that a wireless signal may be received from and/or transmitted to the canal hearing device 100 from the appliance 800. It will be appreciated that the distance defining proximity depends on the wireless capability of the canal hearing device 100 and the wireless protocol. For example, proximity may be 2-10 meters for low energy Bluetooth. In some examples, proximity may be a greater distance than the direct wireless capability of the canal hearing device 100 by using a mesh network. In some examples, the wireless electronics 116 may periodically scan for the presence of an appliance 800, or respond to a scan from the appliance 800. In some examples, the wireless electronics 116 may perform a scan in response to a manual activation of a switch 110-114. The canal hearing device 100 may access appliance control parameters 130 associated with the detected appliance 800 and configuration data 132 from memory 128 of the canal hearing device 100. The appliance control parameters 130 determine the pre-selected control method associated with the appliance 800 and/or switch mapping for the appliance 800 (e.g., which switch performs which command). The configuration data 132 may include personal user settings, personal fitting parameters, appliance preferences, etc. For example, the configuration data 132 may include appliance preferences ranking appliances based on usage or user preference, automatic control settings of an appliance 800 (e.g., automatic door unlock), and/or alert settings for an appliance 800.

In some examples, the canal hearing device 100 may be configured to produce an audible sound (also referred to herein as "audible signal") from the speaker 124 when the canal hearing device 100 is worn in the ear and in proximity to the appliance 800. In some examples, the canal hearing device 100 includes a speaker 124 in the medial portion 106 to deliver audible signals 120 in the ear canal 10. The audible signal 120 may be representative of the audio signal streamed from the appliance 800 or internally generated by the canal hearing device 100 to play a particular audio segment related to the presence or control of the appliance 800. In some examples, audio data 134 associated with the audio segment may be stored in memory 128 of the canal hearing device 100. The audio data stored in memory 128 may be accessed and played back using the sound processor 126 within the canal hearing device 100 in response to the detection, or from the activation or control of the appliance 800 due to hearing device switch activation. The production of the audible signal 120 may be terminated by manually activating any switch of the canal hearing device 100.

In some examples, the canal hearing device 100 may automatically detect the presence of the appliance 800. In response to detection of the appliance 800, the canal hearing device 100 may deliver an appropriate audible signal 120 (e.g., an audible segment) to a user 1 wearing the canal hearing device 100. The audible signal 120 may be produced through the speaker 124. This audible signal 120 may alert the user 1 to the presence of the appliance 800 in proximity and allow the user 1 to wirelessly control the appliance 800 detected in proximity to the canal hearing device 100. In some examples, control of the appliance 800 is automatic. Thus, the one or more switches of the canal hearing device 100 may not be required to control the appliance 800. The canal hearing device 100 may detect the presence of an appliance 800 in proximity to the canal hearing device 100 and control the appliance 800 based on appliance control parameters 130 and configuration data 132 (collectively referred to herein as "configuration parameters") stored within memory 128 of the canal hearing device 100. For example, the canal hearing device 100 may detect the presence of a lock and in response to detecting the lock, the canal hearing device 100 may wirelessly transmit a secure open-door command signal to unlock a door for entry. This may be advantageous to provide a hands-free home entry for a user 1. In other examples, the open-door command is delivered upon activation of a hearing device switch positioned in the concha cavity 5 behind the tragus 3 according to the examples of the present disclosure.

In some examples, upon detection of the appliance 800 in proximity, the canal hearing device 100 may retrieve appliance status data of the appliance 800, for example whether a door is locked or unlocked, or whether the appliance is on or off. The canal hearing device 100 may deliver a wireless control signal to the appliance based on the appliance status data. For example, the canal hearing device 100 may deliver a wireless control signal to unlock the door only when the appliance status data indicates that the door is locked and will not perform any action if the door is already unlocked. In some examples, the canal hearing device 100 may detect whether the appliance 100 is getting closer or further away when in proximity range, for example when the user 1 is approaching a door or moving away from the door, and send a wireless control signal based on the movement direction of the user 1 with respect to the appliance 800. For example, the canal hearing device 100 may unlock a door that the user 1 is approaching and/or lock a door that the user 1 is moving away.

The canal hearing device 100 may be communicatively coupled to a computing device 900 over a wireless interface. In some examples, the canal hearing device 100 may be programmed by the computing device 900, such as a personal computer, a Smartphone, or a tablet. The computing device 900 may include memory 904 for storing control software application 910 for adjusting appliance control parameters 130 and/or configuration data 132 of the canal hearing device 100. For example, the functionality of the switches 110-114 may be customized using the control software application 910. The control software application 910 may executable by a processor 906 of the computing device 900 to send control signals 902 to the canal hearing device 100 for setting the appliance control parameters 130 of the canal hearing device 100. The control software application 910 may be configured to send and receive control signals 902 to and from the canal hearing device 100, such as the appliance control parameters 130, configuration data 132, and/or other status information of the canal hearing device 100.

In some examples, a binaural set of hearing devices may be configured differently and independently for the control of the same of multiple appliances. A first canal hearing device of a binaural set may be configured for controlling a light and a second canal hearing device may be configured for controlling a television. One switch of the first canal hearing device may be configured for actuation of appliances (e.g., On/Off for a TV or lighting), while the switches of the second canal hearing device may be configured to change the settings of the appliances, for example changing the volume, channel, dimming, or other settings.

In some examples, the canal hearing device 100 may include telephony functionalities via wireless connectivity to a telephone. A first switch of the canal hearing device 100 may be manually activated to answer an incoming call. The canal hearing device 100 may deliver a telephone audio signal to the ear canal 10 of the user using the speaker 124 of the canal hearing device 100 in response to the activation of the switch to answer the phone call. A second or the same switch of the canal hearing device 100 may be manually activated to adjust the volume of the telephone audio signal in the ear upon taking the incoming call.

The canal hearing device 100 may store audio data 132 that may be played back using the sound processor 126 and speaker 124 of the canal hearing device 100 to alert the user to an incoming call or message. The alert may be a stored audio segment or may be provided to the canal hearing device 100 wirelessly during the incoming call, for example to include the name of the caller in the alert. The audio data 132 may include voice messages or voice memos. The audio data 132 may include text messages converted to audio messages, such as from e-mail, SMS, social media posts, and/or other text-based messages. The computing device 900, for example a smartphone, may provide the canal hearing device 100 with voice messages, voice memos, and/or text messages converted to audio messages. The canal hearing device 100 may include an interface for presenting stored audio data 132 to the user 1, such as by listing the stored messages and allowing the user 1 to scroll and select the one(s) they wish to play back using the switches 110-114.

In some examples, the appliance 800 may be a medical device. The canal hearing device 100 may detect the presence of the medical device. Upon detection of the medical device or by a command from the medical device, the canal hearing device 100 may deliver an audio signal to the ear canal 10 of the user. The canal hearing device 100 may receive alerts related to medical or health events from the medical device. The canal hearing device 100 may present the alerts to the user 1 by delivering an audio signal to the ear canal 10 of the user 1. In response to a manual activation of a switch of the canal hearing device 100, the canal hearing device 100 may transmit a wireless signal to the medical device for acknowledgment, control or verification. For example, the canal hearing device 100 may communicate wirelessly with an electronic medicine dispenser bottle (referred to herein as "e-dispenser") housing one or more medications (pills, for example) and provide an audible signal as a reminder for the user 1 to take any of the medications upon a wireless request from the e-dispenser. The user 1 may disable or terminate the repeating audio messages by activating a switch on the canal hearing device 100 which may also trigger a wireless confirmation signal to the e-dispenser. The e-dispenser through its processor may perform a verification of taking the medication, for example by ensuring that the user 1 actually opened the bottle during an appropriate time frame. If verification is negative, the e-dispenser may continue to request the canal hearing device 100 to generate an audible reminder signal through the speaker 124 of the canal hearing device 100.

By placing the canal hearing device 100 in the ear canal 10 and extending laterally to the concha cavity 5 behind the tragus 3, the canal hearing device 100 is generally inconspicuously and securely worn within the ear, allowing for normal daily activity including running, hunting, sports and exercising in general. Additionally, the switches of the canal hearing device 100 are configured to be readily accessible to the user 1, e.g., to enable transmission of wireless signals to a variety of appliances, thereby allowing control of other devices used and encountered frequently in daily life.

In some examples, the canal hearing device 100 may be water-proof or water-resistant so as to allow for showering and swimming while the canal hearing device 100 is worn inside the ear canal 10 and behind the tragus 3. The inconspicuous wear of the canal hearing device 100 worn generally behind the tragus 3 disclosed herein allows for discrete and private communications without alerting others. In contrast, existing Bluetooth-enabled hearing devices extend outside the concha cavity 5, including behind the ear, and compromise secure and inconspicuous wear.

Figure 12:
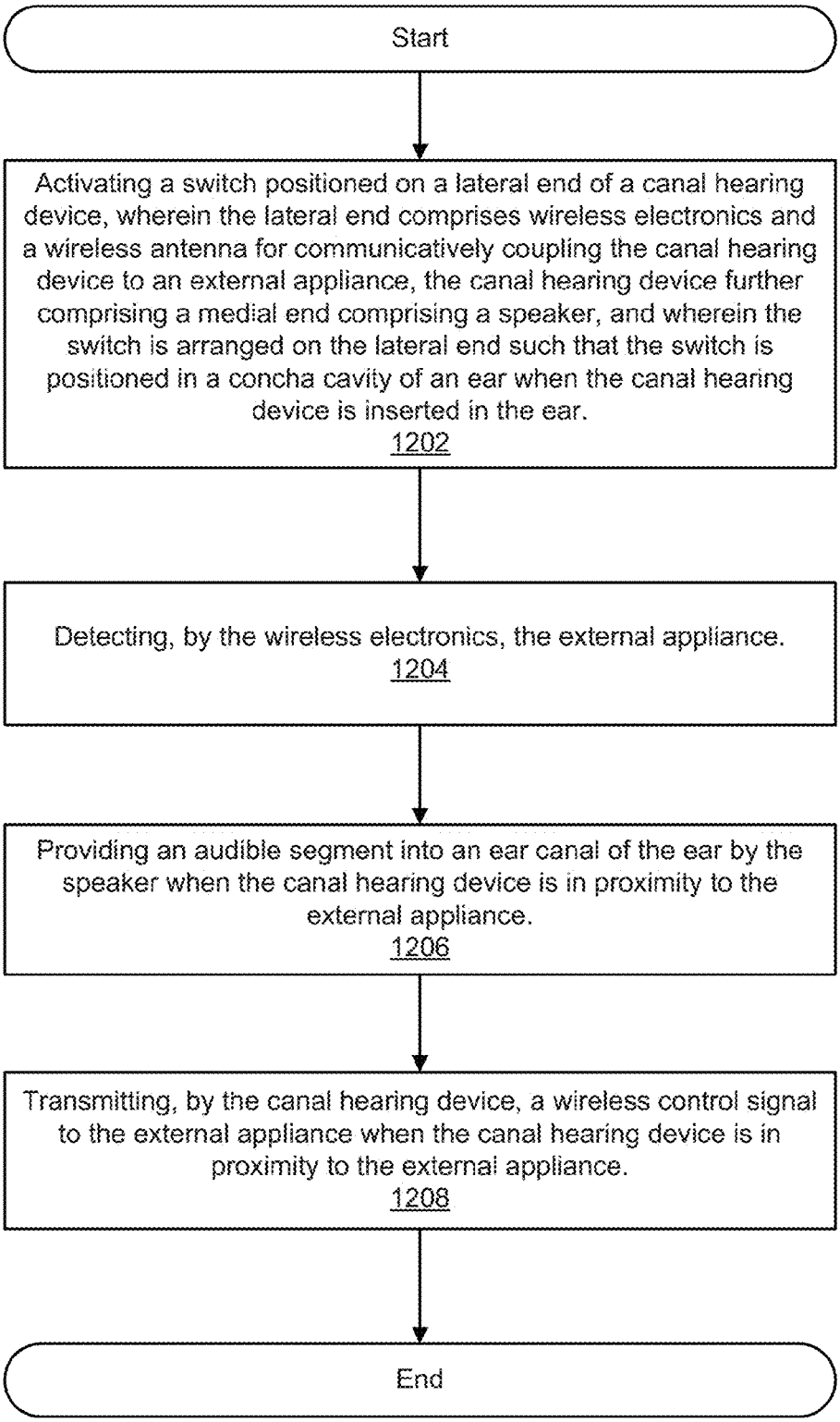
FIG. 12 is a flow chart of a method for control of an appliance by a canal hearing device, according to some examples.
Figure 13:
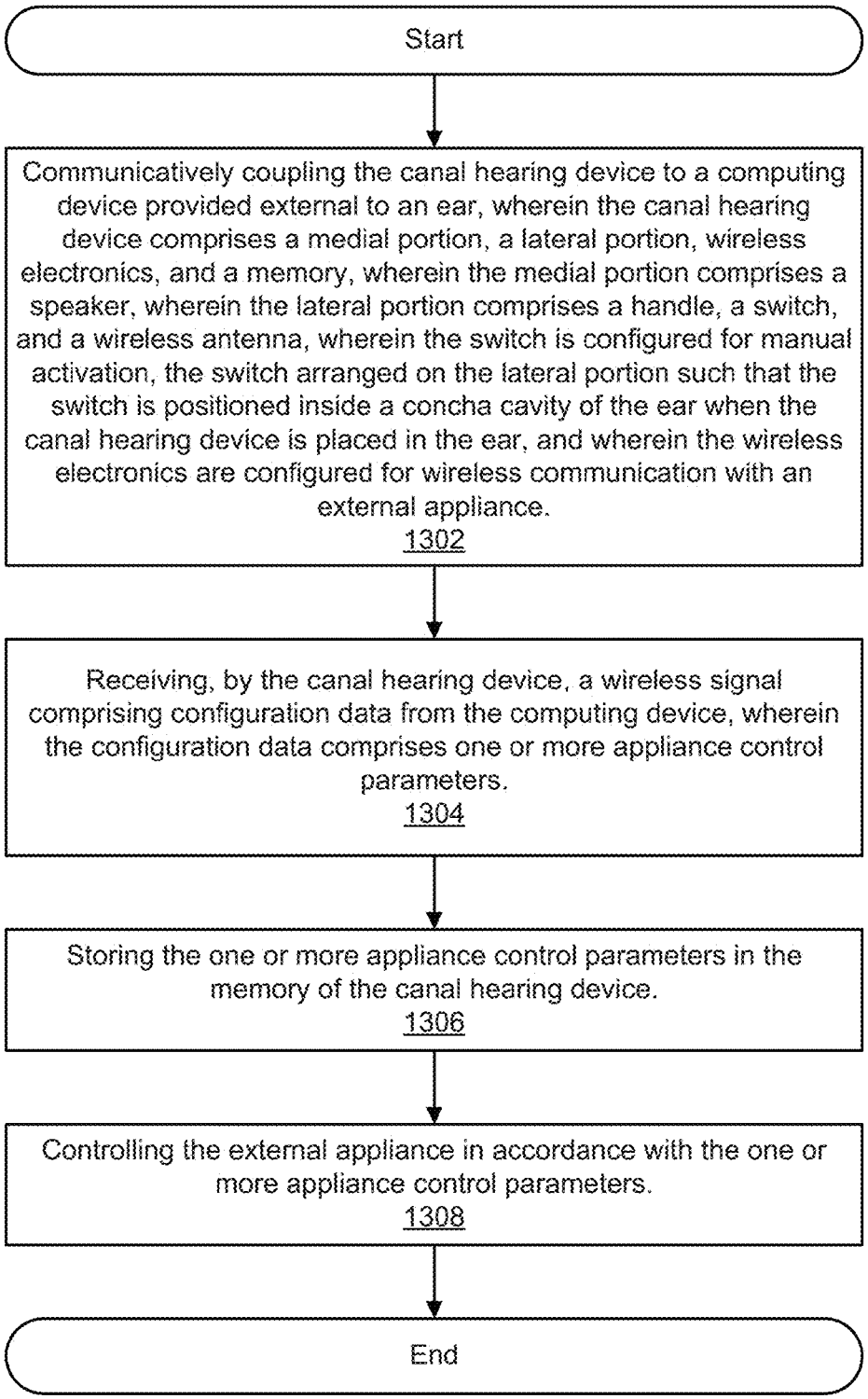
FIG. 13 is a flow chart of a method for configuring a canal hearing device, according to some examples.

FIGS. 12-13 are flow charts of methods one or both of which may be embodied in a canal hearing device and/or a hearing system according to some examples of the present disclosure. While the various steps in these flowcharts are presented and described sequentially, one of ordinary skill will appreciate that some or all of the steps can be executed in different orders and some or all of the steps can be executed in parallel. Further, in some examples, one or more of the steps described below can be omitted, repeated, and/or performed in a different order. Accordingly, the specific arrangement of steps shown in FIGS. 12-13 should not be construed as limiting the scope of the invention.

FIG. 12 is a flow chart of a method for control of an appliance by a canal hearing device, according to some examples. In step 1202, a switch positioned on a lateral end of the canal hearing device is activated. The lateral end may include wireless electronics and a wireless antenna for communicatively coupling the canal hearing device to an external appliance. The canal hearing device may further include a medial end including a speaker. The switch may be arranged on the lateral end such that the switch is positioned in a concha cavity of an ear when the canal hearing device is inserted in the ear. In step 1204, the wireless electronics may detect the external appliance. In step 1206, an audible segment may be provided into an ear canal of the ear by the speaker when the canal hearing device is in proximity to the external appliance. In step 1208, a wireless control signal may be transmitted by the canal hearing device to the external appliance when the canal hearing device is in proximity to the external appliance. The wireless control signal may include configuration parameters.

FIG. 13 is a flow chart of a method for configuring a canal hearing device, according to some examples. In step 1302, a canal hearing device is communicatively coupled to a computing device provided external to an ear. The canal hearing device may include a medial portion, a lateral portion, wireless electronics, and a memory. The medical portion may include a speaker. The lateral portion may include a handle, a switch, and a wireless antenna. The switch may be configured for manual activation. The switch may be arranged on the lateral portion such that the switch is positioned inside a concha cavity of the ear when the canal hearing device is placed in the ear. The wireless electronics may be configured for wireless communication with an external appliance. In step 1304, a wireless signal including configuration data may be received from the computing device by the canal hearing device. The configuration data may include one or more appliance control parameters. In step 1306, one or more appliance control parameters may be stored in the memory of the canal hearing device. In step 1308, the external appliance may be controlled in accordance with the one or more appliance control parameters.

Although examples of the invention have been described herein, it will be recognized by those skilled in the art to which the invention pertains from a consideration of the foregoing description of presently preferred and alternate embodiments and methods of fabrication and use thereof, and that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A hearing device comprising:

a medial portion comprising a speaker, the medial portion configured for placement inside an ear canal;

a lateral portion comprising a wireless antenna and a switch, wherein the switch is configured for manual activation; and wireless electronics communicatively coupled to the wireless antenna and configured to receive one or more control parameters associated with one or more external appliances and store the one or more control parameters in a memory of the hearing device, the wireless electronics further configured to transmit a wireless signal to an external appliance proximate to the hearing device for controlling an operation of the external appliance and responsive to manual activation of the switch, wherein the wireless signal is selected based on a control parameter associated with the external appliance.

2. The hearing device of claim 1, wherein the lateral portion further comprises a battery cell.

3. The hearing device of claim 1, wherein the wireless signal is configured to control any of an electronic lock, an electronic lighting, a telephone, a medical alert system, a television, a medical device, and electronic glass.

4. The hearing device of claim 1, further comprising a sound processor configured to generate an audible signal, wherein the speaker is configured to provide the audible signal inside the ear canal.

5. The hearing device of claim 4, wherein the audible signal is selected based on configuration data stored in the memory of the hearing device, wherein the memory comprises configuration data associated with a plurality of external appliances.

6. The hearing device of claim 5, wherein the audible signal is representative of any of voice messages, voice memos, and text messages.

7. The hearing device of claim 4, wherein the sound processor is configured to select the audible signal in response to a detection of the appliance when in proximity.

8. The hearing device of claim 1, further configured to detect the external appliance in response to activation of the switch.

9. The hearing device of claim 1, wherein the switch is arranged on the lateral portion such that the switch is located in a concha cavity of an ear when the medial portion is placed inside the ear canal.

10. The hearing device of claim 1, wherein the wireless electronics are configured for low energy Bluetooth communications.

11. The hearing device of claim 1, wherein the lateral portion further comprises a handle portion and wherein the switch is on the handle portion.

12. The hearing device of claim 1, wherein the switch is arranged on the lateral portion such that the switch is configured to be oriented towards a tragus of the ear.

13. The hearing device of claim 1, wherein the switch is arranged such that application of a manual force to a tragus of the ear causes activation of the switch.

14. A hearing device comprising:

a medial end comprising a speaker, the medial end configured for placement inside an ear canal of an ear;

a lateral end comprising a switch configured for manual activation;

memory comprising control parameters associated with a plurality of appliances; and wireless electronics configured to communicatively couple to an appliance external to the ear, wherein the appliance is one of the plurality of appliances, wherein the hearing device is configured to produce an audible sound from the speaker when the hearing device is worn in the ear and in proximity to the appliance, and wherein the hearing device is configured to select at least one control parameter associated with the appliance to wirelessly control an operation of the appliance.

15. A hearing device comprising:

a medial end comprising a speaker, the medial end configured for placement in an ear of a user; and wireless electronics configured to receive control parameters associated with an external device positioned external to the ear and transmit a wireless signal to the external device when the external device for controlling an operation of the external device is proximate thereto, wherein the wireless signal is selected based on one or more of the control parameters associated with the external device for controlling an operation of the external device.

16. The canal hearing device of claim 15, the canal hearing device is configured to send wireless signal to the external device in response to the manual actuation of the switch.

17. A hearing system comprising:

a hearing device comprising:

a medial end comprising a speaker, the medial end configured for placement inside an ear canal;

a lateral portion comprising, a switch configured for manual activation;

wireless electronics configured for wireless communication with an external appliance;

memory; and a computing device separate from the canal hearing device and communicatively coupled to the hearing device, wherein the hearing device is configured to receive one or more control parameters from the computing device and store the one or more control parameters in the memory, the hearing device further configured to transmit a wireless signal for controlling an operation of the external appliance based on at least one of the control parameters associated with the external appliance.

18. The hearing system of claim 17, wherein the hearing device is part of a binaural set of hearing devices, wherein the binaural set of hearing devices comprises a first hearing device comprising a first set of control parameters for controlling a first appliance and a second hearing device comprising a second set of control parameters for controlling a second appliance.

19. The hearing system of claim 17, wherein the computing device is any of a personal computer, a smartphone and a tablet.

20. The hearing system of claim 17, wherein the hearing device is a canal hearing device.

21. A hearing device comprising:

a medial portion comprising a speaker;

a lateral portion comprising at least one switch configured for manual activation;

memory storing a plurality of control parameters associated with a plurality of external appliances;

wireless electronics configured to transmit a wireless signal to an external appliance of the plurality of external appliances for controlling an operation of the external appliance, wherein the wireless signal is based on one or more control parameters associated with the external appliance, wherein the hearing device is configured to select the one or more control parameters when the hearing device is in proximity to the external appliance.

22. A method for control of an appliance by a hearing device, the method comprising:

activating a switch of a hearing device;

detecting, by the wireless electronics, an external appliance;

selecting a control parameter associated with the external appliance, wherein memory of the hearing device comprises control parameters associated with a plurality of external appliances; and transmitting, by the hearing device, a wireless control signal to the external appliance for controlling an operation of the external appliance based on the selected control parameter.

23. The method of claim 22, further comprising retrieving wirelessly, by the hearing device, appliance status data of the external appliance and generating, by the hearing device, the wireless control signal according to the appliance status data.

24. A method of communication between an external appliance and a hearing device, the method comprising:

receiving, by wireless electronics of a hearing device, a wireless signal from an external appliance, wherein the hearing device comprises a speaker and memory storing configuration data associated with a plurality of external appliances, wherein the configuration data comprises control parameters for controlling an operation of one or more of the external appliances;

selecting configuration data associated with the external appliance from the memory;

generating, by a processor of the hearing device, one or more audio segments based on the configuration data associated with the external appliance for providing the one or more audible segments into the ear canal by the speaker in response to receiving the wireless signal;

detecting, by the processor, a manual activation of a switch provided on the hearing device; and terminating the transmission of the one or more audible segments in response to detecting the manual activation of the switch.

25. The method of claim 24, further comprising transmitting a wireless signal to the external appliance in response to detecting the manual activation of the switch.

26. A method for configuring a hearing device, the method comprising:

communicatively coupling the hearing device to a computing device provided external to an ear;

receiving, by the hearing device, configuration data from the computing device, wherein the configuration data comprises one or more appliance control parameters;

storing the configuration data in memory of the hearing device;

selecting one or more appliance control parameters associated with an external appliance when the external appliance is in proximity to the hearing device, and controlling the external appliance in accordance with the one or more appliance control parameters.

27. The method of claim 26, wherein the computing device is any of a personal computer, a smartphone, and a tablet.

28. The method of claim 26, wherein the controlling the external appliance includes transmitting, by the canal hearing device, a wireless control signal to the external appliance when the canal hearing device is in proximity to the external appliance.

* * * * *